United States Patent [19]

Larson

[11] 4,148,477

[45] Apr. 10, 1979

[54] SIMULATED SKI SLOPE SLIDE STRUCTURE

[76] Inventor: Ralph Larson, 9 Port of Spain Rd., Coronado Keys, Calif. 92118

[21] Appl. No.: 868,270

[22] Filed: Jan. 10, 1978

[51] Int. Cl.[2] ..... A63G 21/14

[52] U.S. Cl. ..... 272/56.5 SS; 198/580; 198/626; 272/69; 272/97

[58] Field of Search ..... 272/56.5 R, 56.5 SS, 272/69; 198/580, 626, 816; 62/345, 380, 381; 209/272, 428, 470; 193/35 R, 35 MD; 104/137, 134, 135, 136

[56] References Cited

U.S. PATENT DOCUMENTS

| | | | |
|---|---|---|---|
| 318,025 | 5/1885 | Pusey | 272/56.5 R |
| 605,025 | 5/1898 | Spencer | 198/580 X |
| 1,323,243 | 12/1919 | Blyth | 198/626 |
| 2,251,927 | 8/1941 | Ermel | 272/56.5 R |
| 2,779,102 | 1/1957 | Baker | 198/580 X |
| 3,047,291 | 7/1962 | Hall | 272/56.5 R |
| 3,120,385 | 2/1964 | Hall | 272/56.5 SS |
| 3,603,449 | 9/1971 | Snow et al. | 198/580 X |

FOREIGN PATENT DOCUMENTS

| | | | |
|---|---|---|---|
| 784696 | 5/1935 | France | 198/626 |
| 1086010 | 8/1954 | France | 272/56.5 SS |
| 168159 | 3/1965 | U.S.S.R. | 272/69 |

*Primary Examiner*—William H. Grieb
*Assistant Examiner*—Arnold W. Kramer
*Attorney, Agent, or Firm*—Wills, Green & Mueth

[57] ABSTRACT

A simulated ski slope slide including an elongate forwardly and downwardly inclined deck having a flat top surface and elongate endless carrier belt with a fibrous pile surface engaged about the deck to extend longitudinally thereof and driven so that its upper portion moves continuously rearwardly and upwardly relative to the top surface of the deck, a bed of flaked ice interengaged with the pile surface of the carrier belt and an elongate endless retaining belt arranged to occur adjacent the lower and end portions of the carrier belt to engage the bed of ice and hold said bed of ice engaged with the carrier belt when the bed of ice occurs at the lower and end portions of the carrier belt.

10 Claims, 12 Drawing Figures

Fig. 1.
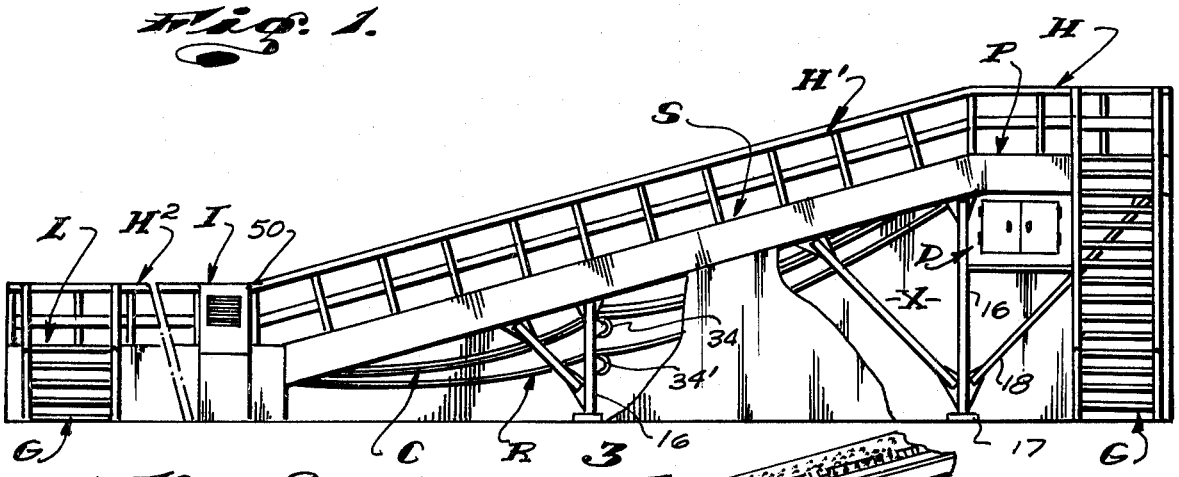
Fig. 2.
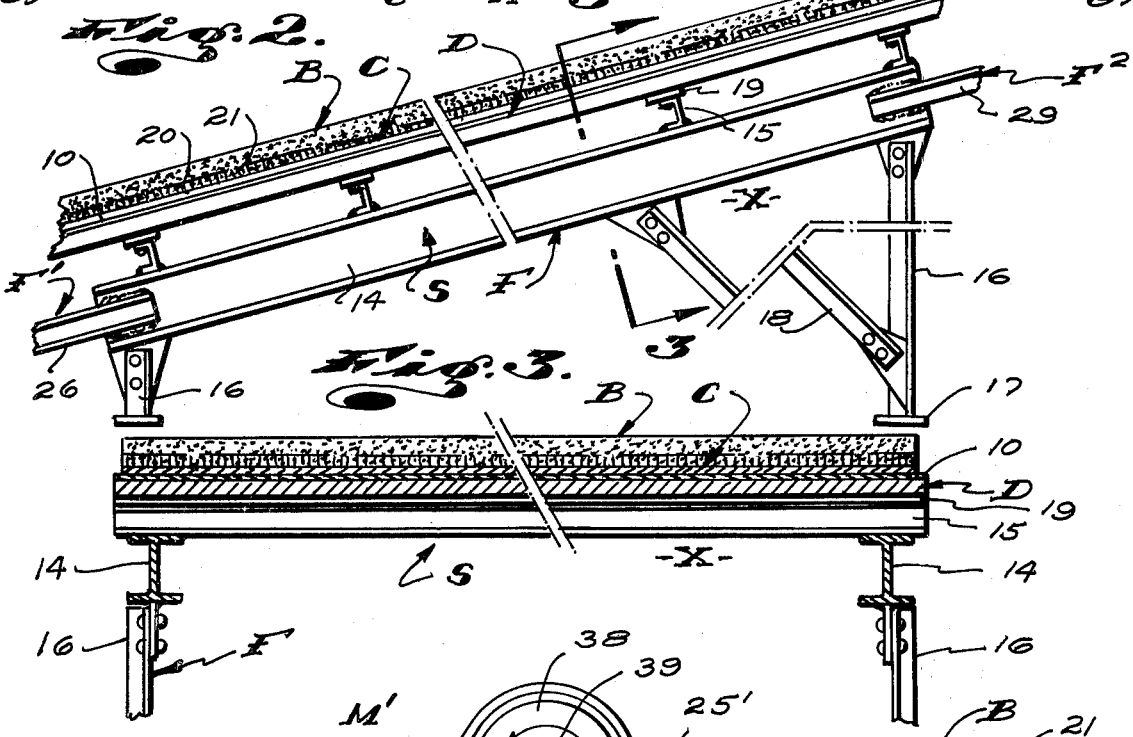
Fig. 3.
Fig. 4.
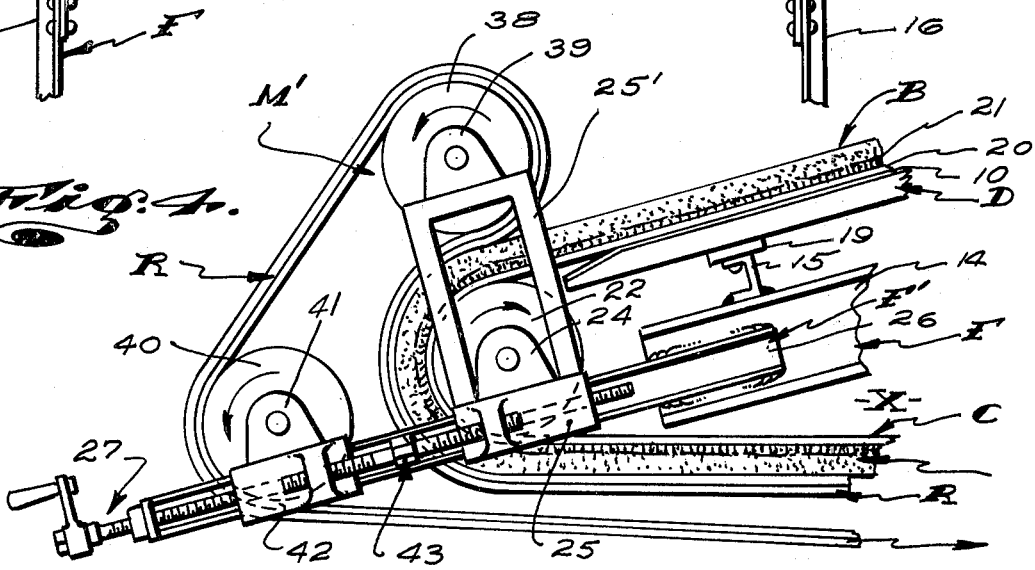

SIMULATED SKI SLOPE SLIDE STRUCTURE

BACKGROUND OF THE INVENTION

This invention relates to the art of skiing and is particularly concerned with an improved simulated ski slope slide structure.

Most people who engage in the sport of skiing find it desirable, if not necessary, to undertake special programs to learn and/or perfect required skiing skills and to attain proper physical conditioning, prior to actively engaging in the sport. Such programs are generally entered into the fall of the year, in anticipation of the coming winter skiing season.

In furtherance of the foregoing, there has been a long felt need for artificial or simulated ski slopes or slides than can be effectively utilized in the preseason training and conditioning programs commonly followed by both experienced and novice skiers.

To the above end, the prior art has provided many different simulated ski slope slide structures. The slide structures provided by the prior art commonly include elongate, longitudinally inclined deck structures carried by suitable support means and having upper rear ends and lower front ends. The elongate inclined decks of the prior art slide structures commonly have means related to their top surfaces intended to simulate the physical conditions of the top surface of packed snow, as it affects the action or working of skis therewith. That is, means are related to the decks of such slides which serve to reduce the coefficient of friction between the deck and skis to a coefficient of friction which is likely to exist between snow and skis whereby a skier can slide down the slide at about the same rate as he might slide down a snow covered slope of like angular disposition. Further, efforts have been made to provide such means which simulate or approximate the compactability and looseness of snow whereby the manner in which skis work on and with the slide structures is such that the skier can attain ski action and experienced feel which are suggestive of the action and feel a skier experiences when skiing on snow.

To the above end, the means related to the decks of simulated ski slope slides provided by the prior art have included various mechanical means such as ski engaging anti-friction rollers arranged throughout the slide decks; riffling and liquid flooding means on and throughout the decks; air cushioning means; special carpets of the plastic fibre having low coefficients of friction with skis; and the like.

While such prior art means have proved to be such that one can effectively ski on them, they tend to provide an extremely slow skiing surface and afford ski action and feel which is so distinct from the action and feel afforded by snow that their value for training and practice purposes is not only questionable, but is considered detrimental by many skiing experts.

OBJECTS AND FEATURES OF THE INVENTION

It is an object and feature of my invention to provide a novel, improved, simulated ski slope slide structure which establishes and maintains an elongate inclined bed of loosely compacted flaked ice which simulates compacted icy snow, on or across which a skier can effectively ski.

Another object and feature of this invention is to provide a structure of the general character referred to above wherein the bed of flaked ice is substantially continuously replenished and its surface is dressed and/or conditioned whereby said bed is maintained to provide uniform, optimum, skiing conditions at all times.

Another object and feature of my invention is to provide a structure of the general character referred to above wherein the carpet carrier is an elongate endless belt of carpet having elongate, longitudinally extending upper and lower portions and recurvant or turned end portions. The endless carpet carrier belt is adapted to be intermittently and/or continuously rotated or advanced with its upper portion moving longitudinally rearwardly and upwardly and its lower portion moving longitudinally forwardly and downwardly.

It is an object and feature of my invention to provide a structure of the character referred to above which includes an elongate flat deck engaged below and supporting the upper portion of the carrier means or belt, roller means engaged within and supporting the ends of the belt, drive means to rotate the rollers and move said belt and support means to occur below the lower portion of a carrier belt, to engage and support the bed of flaked ice on said lower portion of the carrier belt and prevent its displacement therefrom.

Still another object and feature of the present invention is to provide a structure of the general character referred to above wherein the support means includes an elongate endless support belt of carpet or the like supported beneath the lower portion of the carrier belt and having an upper portion normally engaging and supporting the bed of ice carried by the lower portion of the carrier belt.

Another object and feature of my invention is to provide a structure of the character referred to wherein the roller means for the support belt draws the upper rear end portion of that belt upwardly and rearwardly relative to the rearwardly and downwardly turned portion of the upper rear end of the carrier belt whereby the belts establish a transversely extending upwardly opening trough across the upper rear end of the carrier belt into which loose flaked ice advanced rearwardly over the upper rear end of the carrier belt drops and is collected to be advanced and recombined with the bed of ice by the support belt as the upper portion of the support belt moves forwardly and downwardly with the loser portion of the carrier belt.

The foregoing and other objects and features of my invention will be apparent and will be fully understood from the following detailed description of one typical preferred form and embodiment of the invention.

DESCRIPTION OF THE DRAWINGS

FIG. 1 is a side elevational view of a simulated ski slope slide embodying my invention;

FIG. 3 is a sectional view taken substantially as indicated by line 3—3 on FIG. 2;

FIG. 4 is an enlarged view of roller means at one end of the slide structure;

FIG. 7 is an enlarged view of a portion of carpet material used to establish the carrier and the support belts of my invention;

Figure 5:
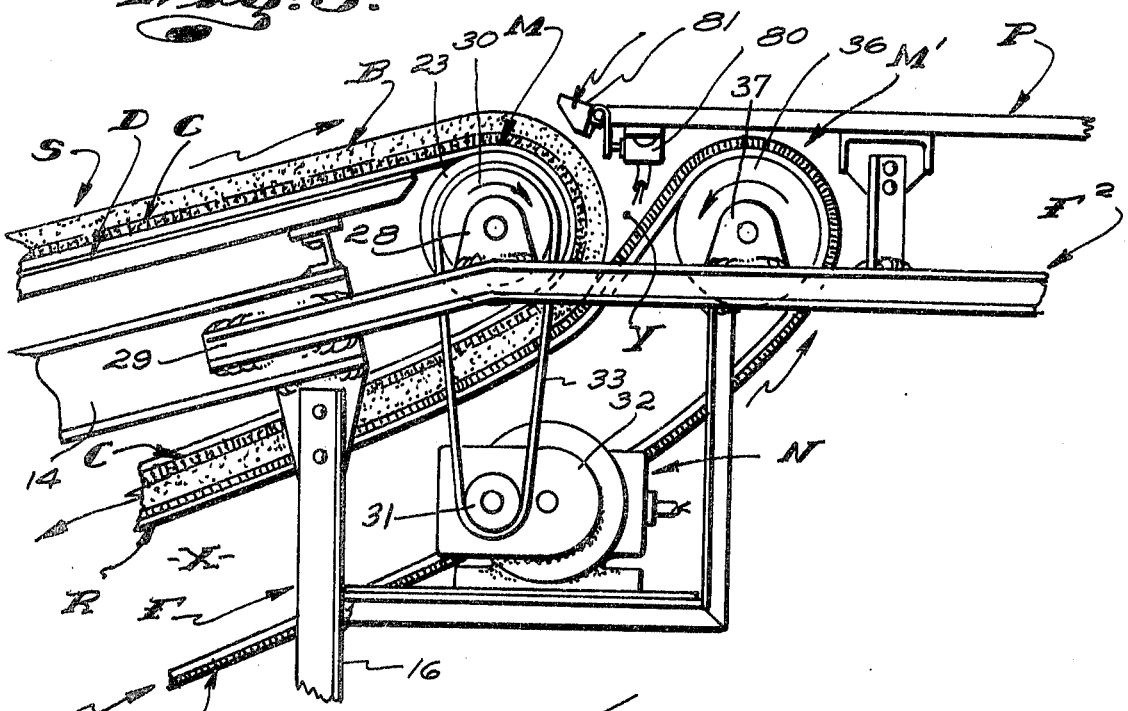
FIG. 5 is an enlarged view of roller means on the other end of the slide structure.

The simulated ski slope slide structure that I provide is an elongate structure with front and rear ends and includes a central slide portion or structure S, a starting platform P at the rear end of the central portion and a landing platform L at the front end of said central portion.

The central portion or slide structure S includes a flat, longitudinally extending, forwardly and downwardly inclined deck D and an open ground engaging frame structure F below and supporting the deck D. The deck D can be established of plywood or other suitable decking material and is preferably provided with a smooth hard skin 10 of plastic, sheet metal or other impervious material which is slick and has a low coefficient of friction when wetted.

The frame F supporting the deck D is such that it reinforces and firmly supports the deck in spaced relationship above the ground and leaves an unobstructed space X between the deck and the ground. The space X between the deck and ground is substantially coextensive with the lateral and longitudinal extent of the deck and is open and unobstructed at the front and rear ends of the deck.

In the case illustrated, the frame F includes a plurality of laterally spaced elongate, forwardly and downwardly inclined I-beams or stringers 14, a plurality of longitudinally spaced laterally extending channel iron joists 15 supported by and fixed to the tops of the stringers 14 and a plurality of vertical angle iron columns 16 with upper ends fixed to the stringers at and along the opposite sides of the frame and ground engaging pads 17 at their lower ends.

In addition to the foregoing, the frame F includes suitable reinforcing braces 18 fixed to and extending between the columns and their related stringers and the joists 15 have deck supporting wooden cleats 19 secured to their top sides and to which the deck D is fixed as by means of screw fasteners or the like (not shown)

The slide structure S next includes an elongate, flexible, endless carrier belt C engaged about and extending longitudinally of the deck D. The belt C is substantially coextensive with the lateral extent of the dock, has an upper portion overlying and in sliding supporting engagement with the top surface of the deck; a lower portion extending longitudinally freely through the above noted unobstructed space X beneath the deck; and, has upper and lower turned or recurvant end portions integrally joining and extending between the above noted upper and lower portions.

The carrier belt C is preferably established of a length of carpet material having a non-stretchable fabric base or backing 20 and a resilient fibre pile 21 projecting upwardly from the backing. A belt without pile can be employed, but it requires more use of the spreader. The backing 20 and the pile 21 are preferably established of a suitable synthetic fibre, such as nylon, whereby said belt is highly resistant to water; is tough and durable; and, is imparted with substantial and desirable flexible and resiliency. The ends of the length of carpet establishing the belt C are suitably joined to establish the endless belt with the pile 21 disposed outwardly and with the backing 20 disposed inwardly.

In practice, the pile 21 of the belt C can be cut pile, loose pile, or a combination of both cut and loose pile, as desired and as circumstances require.

The belt C is adapted to support and to carry a bed B of flaked ice. The bed B of flaked ice is applied to and is suitably mechanically locked into and with the resilient pile 21 of the belt. Loop pile tends to establish a better mechanical lock in and with the bed of ice and affords greater vertical resiliency than does cut pile. On the other hand, cut pile tends to afford greater lateral flexibility and allows for desired limited lateral deflection and/or displacement of the ice flakes going to make up the bed B of ice. As a result of the foregoing, while substantially any carpet material will suffice, the working characteristics of the bed of flaked ice related to the carpet can, to a noticeable extent, be controlled by selecting and use of carpet having particular pile structure.

The central portion or side structure S of my invention next includes roller support means M and drive means N to support and drive the carrier belt C longitudinally about the deck D. The means M includes elongate, horizontal, laterally extending front and rear support rollers 22 and 23 arranged adjacent the front and rear ends of the deck D with their top or upper slides substantially tangential with the top surface of the deck and about which the ends of the belt C are engaged.

Referring to FIG. 4 of the drawings, the front roller 22 at and across the lower front end of the deck D is a tensioning roller and is rotatably supported at its ends by suitable journal boxes 24 carried by a carriage 25. The carriage 25 engaged with and supported by a pair of laterally spaced rails 26 of a forward extension F′ of the frame F. The rails 26 are fixed to the stringers 14 of the frame F to project forwardly therefrom.

A suitable manually operable screw means 27 is engaged with and between the carriage 25 and one of the frame structures F′. The means 27 is operable to move the carriage 25 and the roller 22 axially forward relative to the longitudinal axis of the construction to tension the belt C.

Referring to FIG. 5 of the drawings, the roller 23 at and extending across the upper rear end of the deck D is a drive roller and is rotatably supported by journal boxes 28 carried by side rails 29 of a rear extension $F^2$ of the frame F. The side rails 29 are fixed to and extending rearwardly from the outside stringers 14 of the frame F.

The drive means N is related to the roller 23 and operates to rotate that roller and to drive and move the belt C so that the upper portion of the belt moves or travels upwardly and rearwardly across and relative to the top surface of the deck D. The means N can vary widely in form and in construction. In the case illustrated, the means N includes a driven pulley wheel 30 at one end of the roller 23; a drive pulley 31 in operating alignment with and spaced below the wheel 30; and a gear reduced electric drive motor 32 carried by a portion of the frame structure $F^2$ and drivingly carrying the wheel 31. The means N next and finally includes an endless drive belt 33 engaged about and between the wheels 30 and 31.

In practice, the motor 32 is preferably a variable speed motor and is such that it can be adjusted to alter or change the speed at which the belt C is moved or travels.

In addition to the rollers 22 and 23, the means M includes one or more support rollers 34 extending laterally of and in spaced relationship below the deck D and below the lower portion of the belt C. The rollers 34 serve to accept the weight of and to support and hold the lower portion of the belt C up at one or more stations or points intermediate the ends thereof, as circumstances require. In the case illustrated, I have shown one roller 34 rotatably supported by journal blocks 35 fixed to vertical columns 16 of the frame F which occur intermediate the ends of the frame and which extend between the ground and the outside stringers 14 of the frame.

The slide structure S next includes an elongate endless, flexible, retaining belt R. The belt R is adapted to engage the bed B of flaked ice carried by the belt C and to hold the bed of flaked ice engaged on and with the belt C when the bed B is not at the top of the belt C.

The retaining belt R is substantially equal in lateral extent with the belt C and is longer than the belt C. The belt R has longitudinally extending upper and lower or top and bottom portions and recurvant or turned end portions. The upper portion of the belt R is coextensive with and occurs adjacent the lower portion of the belt C, with the bed B of flaked ice engaged therebetween. The belt R supports the bed B and also supports the lower portion of the belt C so that the bed of ice is maintained engaged with the belt C and is prevented from separating and dropping from the belt C.

The belt R is so related to the belt C that the support roller or rollers 34 of the means M provided to support the lower portion of the belt C, intermediate its ends, engages and supports the upper portion of the belt R. That is, the lower portion of the belt C is not directly supported by the roller 34, but is supported by that roller through the upper portion of the belt R (see FIG. 6 of the drawings).

Referring once again to FIG. 5 of the drawings, the upper rear end of the belt R extends upwardly and rearwardly from the lower rear portion of the drive roller 23 and portions of the belt C and bed B related threreto define a laterally extending upwardly opening trough across the upper rear end of the belt C to catch and in which loose flaked ice, advanced to and over the upper rear end of the belt C, is collected. As the belt C continues to move and as the belt R moves therewith, the loose flaked ice collected in the trough Y is effectively advanced downwardly and forwardly with and between the belts to be effectively rejoined or combined with the bed B of ice.

Referring to FIG. 4 of the drawings, the lower front end of the belt R extends forwardly, upwardly and thence rearwardly about the forward half of the roller and the front end of the belt C, to engage and hold the bed of ice on the belt C as it is flexed and advanced forwardly upwardly and thence rearwardly about the roller 22 and into engagement with the lower front end of the deck D.

To correlate the belts C and R and to attain the above noted functions, the structure that I provide includes roller support means M′ for the belt R. The means M′ includes an elongate free turning rear roller 36 in parallel relationship with the upper rear roller 23 of the means M. The roller 36 is spaced rearward of the roller 23 on a common horizontal plane therewith. The rear roller 36 is carried by pillow blocks 37 fixed to the frame extension $F^2$. The lower rear portion of the retaining belt R advances rearwardly and upwardly to tangentially engage the roller 36 at the lower rear quarter thereof while the upper portion of that belt advances forwardly and downwardly from the upper forward quarter of the roller 36 and tangentially engages the bed B of ice on and carried by the belt C, radially outward from the lower rear quarter portion of the roller 23 of the means M.

Referring to FIG. 4 of the drawings, the means M′ next includes an upper roller 38 arranged above and in parallel relationship with the roller 22 of the means M and about which the forward end of the belt R is engaged whereby the belt R is directed and held in engagement with the bed B of ice on the forward end portion of the belt C engaged about the forward half of the roller 22.

The upper roller 38 is rotatably supported by pillow blocks 39 fixed to an upwardly projecting frame structure 25′ on the carriage 25.

The means M′ next includes a forward guide roller 40 arranged in forward spaced relationship with the roller 22 of the means M and spaced forward and below the upper roller 38. The roller 40 is rotatably supported by pillow blocks 41 on a second carriage 42 shiftably supported or carried by the rails 25 of the frame extention F′. The carriage 42 is shiftable longitudinally of the rails 25 and is selectively shiftable longitudinally relative to the carriage 24 whereby tensioning of the belt R relative to the belt C can be adjusted.

To the above end, I have shown suitable screw means 43 engaged with and between the carriages 25 and 42. The means 43 drivingly couples the carriages together and is operable to vary and adjust the distance or space between the carriages, longitudinally of the rails 25.

It will be apparent that the forward advancing upper portion of the belt R, which is engaged with and supports the bed B of ice on the lower forwardly advancing portion of the belt C, is driven and moved therewith by virtue of the frictional engagement established between the belt R and the bed B of ice.

The forwardly advancing forward portion of the belt R related to the rollers 22, 38 and 40, advances forwardly upwardly and thence rearwardly about the forward half of the roller 22, then advances upwardly, forwardly and downwardly about the upper portion of the roller 38 and thereafter advances downwardly and rearwardly about the roller 40 where the lower portion of that belt advances rearwardly and upwardly through the space X below the deck, to the upper rear roller 36 of the means M′.

From the foregoing, it will be apparent that the belt R engages the bed B of ice on the belt C as it is turned and advanced about the roller 22 and does not release or disengage the bed B until that bed has advanced to that position where it occurs at the top of the straight upwardly and rearwardly moving top portion of the belt C.

Figure 6:
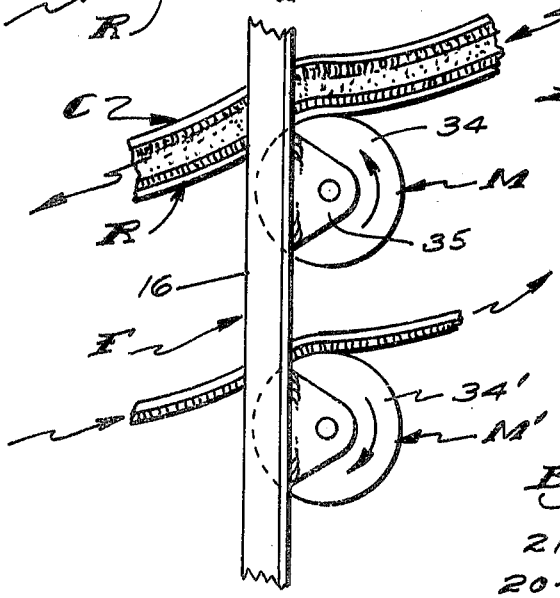
FIG. 6 is an enlarged view of intermediate roller means.
Figure 2:
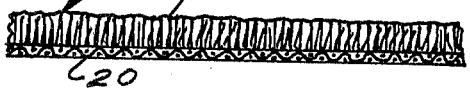
FIG. 2 is an enlarged detailed view of a portion of the structure that I provide.

In addition to the foregoing, the means M′ can include one or more intermediate support rollers 34′ to engage and support the lower portion of the belt R, intermediate the ends thereof and as shown in FIGS. 1 and 6 of the drawings.

In practice, the belt R can be established of any suitable flexible fabric or sheet material. In the preferred carrying out of the invention, the outer surface of the belt R, which opposes and engages the bed B of flaked ice, is provided with a suitable texture which forms or impresses a corresponding texture into the surface of the bed B of ice.

It has been found that the belt R should have good heat insulating characteristics so that it effectively insulates the outer surface of the bed of ice throughout that time when the belt R is engaged with it and to thereby slow and reduce melting of the ice going to make up the bed B.

To the above end, it has been found that the belt R can be satisfactorily established of suitable carpet material of suitable fibre with, for example, a tight or compact loop pile of desired texture at its outer surface. Such a carpet material establishes a suitable thermal insulation for the bed B of ice engaged therewith and the pile of the carpet suitably impresses a desirable texture into the surface of the bed of ice.

The slide structure S that I provide preferably includes flaked ice supply means I and flaked ice distributing means E to deposit and spread flaked ice on and across the outer surface of the carbet C.

In the form of the invention illustrated, the flaked ice supply means I includes an ice flaking machine 50 arranged at one side of the deck 10 at the lower front end thereof. The machine 50 operates to dispense and deposit flaked ice on the top of the belt C at one side and at the lower end of its upper portion. The machine 50 can vary widely in form and construction. In practice, the machine can be a simple motor driven mill-type ice shredder or flaking machine such as is commonly employed in commercial ice houses to produce chipped or flaked ice. Such machines are simple motor driven mills into which block ice is fed and from which flaked ice is discharged. The milling means of such machines are commonly adjustable so that the texture of flaked ice discharged therefrom and the rate at which the ice is flaked and discharged can be adjusted, as circumstances require.

Since the exact construction and operation of the machine 50 can vary widely without affecting the novelty of my invention, and since structural details of the machine 50 form no part of my invention, I have elected to show the machine 50 in a diagrammatic manner, that is, I have shown the machine as a simple cabinet unit arranged at one side of the deck D at the lower front end portion thereof.

Figure 11:
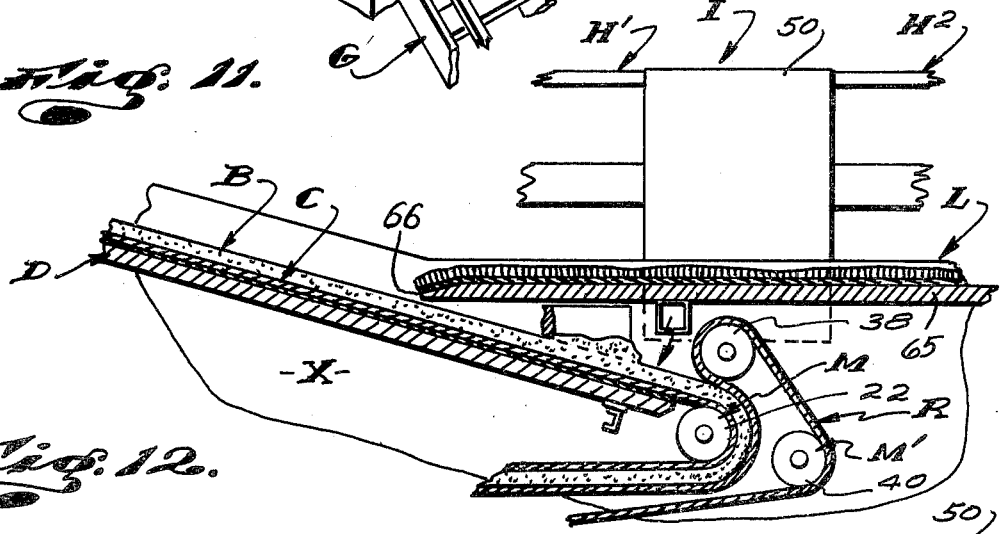
FIG. 11 is an enlarged sectional view taken substantially as indicated by line 11—11 on FIG. 10.
Figure 12:
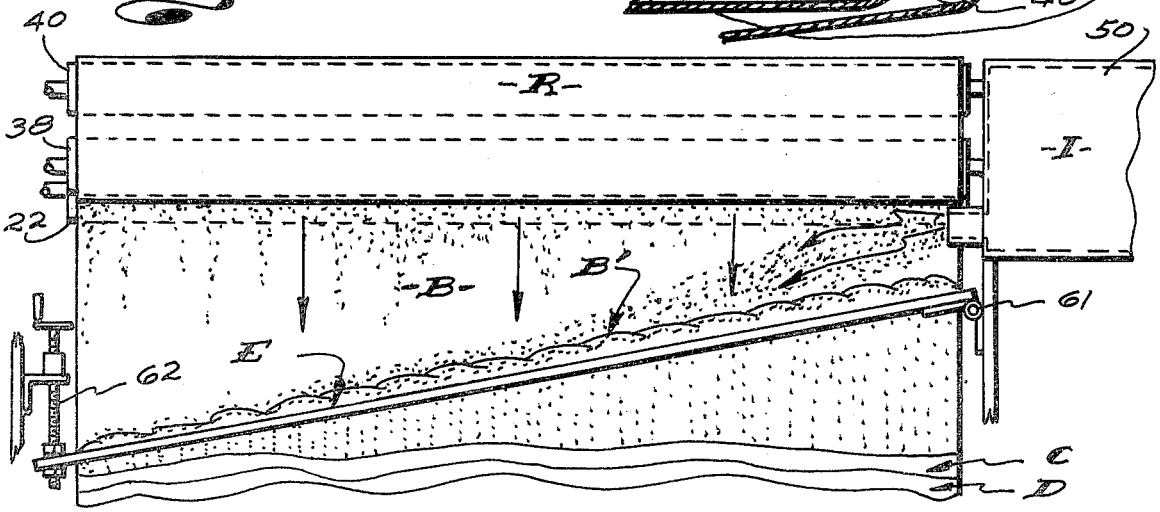
FIG. 12 is an enlarged sectional view taken substantially as indicated by line 12—12 on FIG. 10.

The distributing means E that I provide and which is shown in FIGS. 11 and 12 of the drawings, includes an elongate screed 60 arranged in predetermined spaced relationship above and extending substantially laterally of the upper portion of the belt C, immediately rearward of the point or station at which the ice machine 50 is positioned. The screed 60 can be established of an elongate board, such as a 2"×10".

In the form of the invention illustrated, the end of the screed 60 adjacent the machine 50 is pivotally mounted to suitable mounting structure provided on the frame F, by a hinge 61. The screed 60 is arranged to extend laterally and upwardly or rearwardly from the hinge 61 across the top of the belt C, to the other or opposite side of the slide structure. The other end of the screed, at said other side of the structure, is engaged and held in position by manually operable screw means 62. The screw means 62 is operable to shift its related end of the screed longitudinally of the slide and to thereby vary or adjust the angle of the screed relative to the slide structure.

The angle of the screed 60 is such that as the portion of the belt C adjacent thereto moves rearwardly and upwardly and transports the bed B of ice and new flaked ice deposited thereon, rearwardly and upwardly relative thereto, the screed functions to scrape and level the surface of the bed B, if such is required and to direct and urge loose and newly deposited flaked ice laterally from one side of the bed toward the other or opposite side thereof whereby the bed B of flaked ice is maintained substantially smooth and of uniform thickness.

The screw means 62 is provided to adjust the angle of the screed 60 so that its capacity or ability to direct and urge loose ice laterally of the construction can be adjusted, as circumstances require. Such adjustment of the screed is likely to be required when, for example, the particle size of the flaked ice is changed and/or as the wetness and fluidity of the flaked ice changes.

With the slide structure thus far described, it will be apparent that the upper portion of the belt C moves continuously rearwardly and upwardly across the deck 10 and that the bed B of flaked ice engaged on and with the belt C moves rearwardly and upwardly therewith to present a substantially smooth upwardly moving forwardly and downwardly inclined flaked ice skiing surface.

The particles of flakes of ice going to make up the bed B work into the pile 21 of the belt C and also stick or fuse together whereby the inner or base portion of the bed B, adjacent or related to the belt C, is effectively locked in and with the pile 21 thereof. With such a relationship, the belt and bed establish a substantially integrated unit.

During operation of the construction, as the belts C and R advance around the rollers 30 and 36 at the upper end of the slide structure S and converge to engage the bed B therebetween, sufficient force is exerted on the bed B to compact the flaked ice to an extent that the flakes of ice establish bridging engagement with each other. As the belts continue to move longitudinally forwardly beneath the deck D, with the bed B engaged therebetween, the bridging ice particles or flakes weld together to a sufficient extent that it will not, in the absence of externally applied forces, shift, break up or otherwise become displaced from the belt C.

As mentioned in the preceding, the belt R serves to emboss or impress a suitable texture into the surface of the bed B. In practice, the texture impressed into the bed is such that it provides a non-slip surface for newly applied ice flakes deposited and distributed on and across the surface of the bed by the means I and E.

In practice, the bed B of flaked ice is sufficiently fixed so that the pile 21 of the belt C is below the surface of the bed a sufficient distance so that, in normal use of the structure and when skis are made to slide and cut into the bed, the pile of the belt C is not ordinarily exposed and engaged by the skis.

Figure 8:
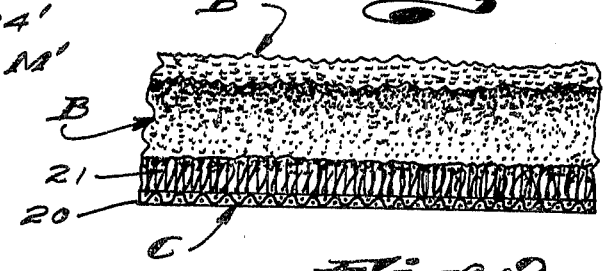
FIG. 8 is a view showing the bed of flaked ice related to the support belt.
Figure 9:
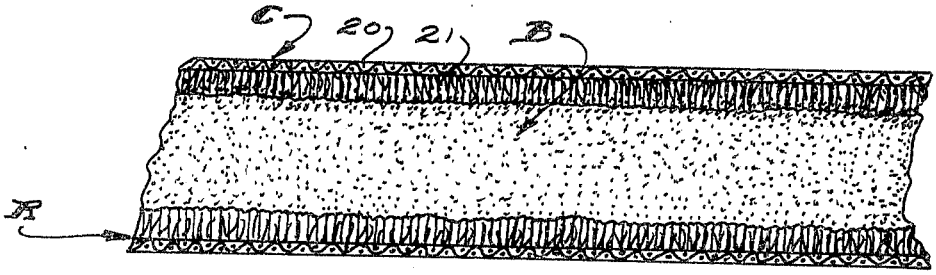
FIG. 9 is a view showing the bed of flaked ice between the carrier and support belts.

As shown in FIG. 8 of the drawings, the bed B can be about twice as thick or deep as the pile 21 of carpet C and the layer of newly applied ice flakes B' need only be of sufficient thickness or depth to completely cover the bed B. The minimum required thickness of the layer B' of flaked ice depends largely upon the texture imparted into the surface of the bed B by the belt R. When the surface texture of the bed B is characterized by close, upwardly projecting, fragile peaks of ice, the layer B' can be very thin. For example, it may be no more than one-sixteenth of an inch. When the surface texture of the bed B is relatively smooth and flat, the layer B' must be thicker. For example, it might be as much as one-quarter of an inch thick.

It is to be particularly noted that in normal operation and use of my slide structure, it is not always necessary that a fresh, new layer B' of ice be continuously applied to the surface of the bed B. In operation and use of the construction, when the bed B is fully established and sufficient additional ice is on the bed so that the screed 60 must shave and dress the surface of the bed, such shaving and dressing of the bed breaks up and loosens the surface of the bed to an extent that the surface of the bed is sufficiently loose and fluid to afford excellent skiing conditions.

Once the bed B is built up to the extent noted above, the machine I need only operate to replace ice which melts or which is displaced from the slide structure by skiing activity carried out thereon.

The starting platform P at the upper rear end of the central portion or slide structure S is a simple flat horizontal platform on a plane substantially tangential with the surface of the bed B of flaked ice as that bed of ice advances over the top of the upper rear roller 30 of the means M. The platform P is substantially rectangular in plan configuration and extends rearwardly from the roller 30 a sufficient distance to establish an area on and about which skiers can stand and move abour, preparatory to skiing on the skiing surface established by the means S.

The platform P includes a deck of plywood or the like supported by a rearwardly extending portion of the above noted frame extension $F^2$, as clearly illustrated in FIGS. 1 and 5 of the drawings.

As shown in FIG. 1 of the drawings, the platform P is equipped with suitable stairs or ladder G up which skiers, on the ground, can ascend and is provided with a safety fence and handrail structure H at its side and rear edges. The fence and handrail structure H extends forwardly and downwardly along the opposite sides of the central portion or slide structure S, as shown at H' in FIGS. 1 and 10 of the drawings.

Figure 10:
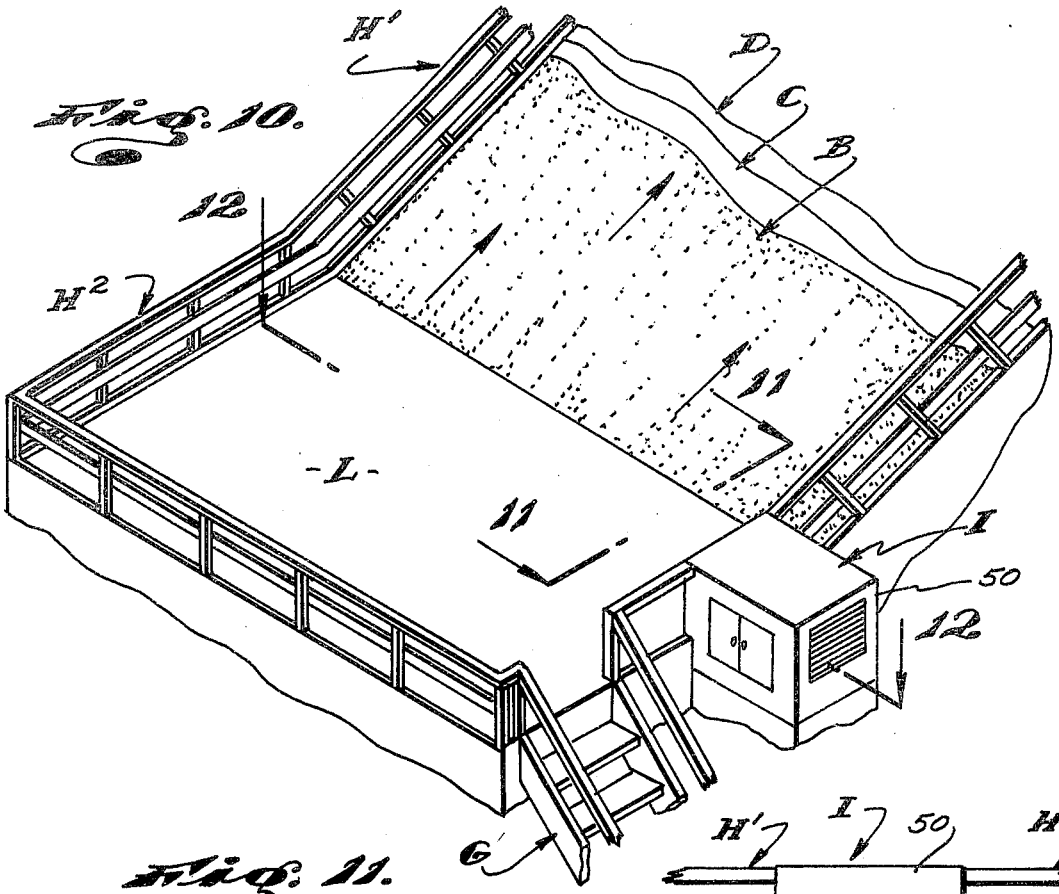
FIG. 10 is an isometric view of the lower forward end of the slide structure shown on FIG. 1.

The landing platform L at the lower front end of the slide structure S is a flat horizontal platform on a plane which occurs immediately above and clear of the roller 38 of the means M'. The landing platform, as shown in FIGS. 1, 10 and 11 of the drawings, comprises a flat horizontal rectangular deck structure 65 with a rear edge 66 occurring in close parallel spaced relationship with the surface of the bed B of flaked ice, rearward of the means E and I and those parts of the means M and M' which occur at the front end of the slide structure S.

The deck structure 65 extends forwardly from its above noted rear edge 66 to overlie the above noted means at the front end of the slid structure S and continues forward a sufficient distance to provide adequate area and/or space onto which skiers, skiing down and from the lower end of the slide structure S can advance and come to a safe stop. The deck 65 of the platform L can be established of plywood supported by a suitable frame structure which can be separate from or an integral part of the forward frame extension F'.

The platform L is preferably provided with suitable stairs or a ladder G' down which skiers can descend to ground level and, as shown, is surrounded at its side and forward edges with extensions $H^2$ of the safety fence and handrail structure related to the central portion S and platform P.

In accordance with the preferred carrying out of my invention, the outwardly disposed vertical sides of the construction are covered by panels of suitable sound and heat insulating material which serve to enhance the appearance of the construction by obscuring all structural and mechanical components or means which occur beneath the top surfaces of the construction; blanket undesirable sounds generated by working of the construction; and, insulate all of the construction which occurs below the top surfaces of the construction from the ambient atmosphere and other external sources of heat which would otherwise tend to heat the construction and cause rapid, premature melting of the ice establishing the bed B.

Finally, in the preferred carrying out of my invention, the gear reduced motor 32 of the drive means N includes or has an electrically operated clutch related to it, whereby normal driving and movement of the belt C can be temporarily stopped, by actuation of the clutch. The clutch is under control of a switch 80 which is actuated by an elongate bar 81 pivotally related to and normally projecting forwardly and upwardly from the front edge of the platform P, as shown in FIG. 5 of the drawings. The bar 81 is such that when a skier positions his skis to project forwardly over and from the forward edge of the platform P, preparatory to propelling himself forwardly and downwardly onto the skiing surface of the bed B of flaked ice, the skis engage and pivot the bar 81 downwardly to close the switch 80, actuate the clutch and thereby stop upward and rearward movement of skiing surface defined by the bed B. When the skiing surface is stopped in the manner set forth above, the skier propels himself forwardly into engagement on the stationary skiing surface and commences to ski down that surface. As the skier's skis disengage the bar 81, the switch 80 opens, the clutch is reset and the skiing surface commences to move rearwardly upwardly at approximately the same rate that the skier travels relative to the skiing surface.

As a result of the above, the skier can commence to ski in a normal manner, that is, as if he were skiing on a stationary ski slope. Thereafter, the skiing surface commences and continues to move counter to the direction in which the skier is traveling and at approximately the same rate of speed. As a result of the above, the skier can continue to ski for protracted periods of time and will not reach the lower end of the slide structure and advance onto the landing platform L unless and until he alters and changes his skiing procedure and/or technique to increase his speed to a speed which is greater than the speed at which the belt B is traveling.

The capability to stop the upward rearward movement of the belt B or skiing surface in the manner set forth above is most important since if that surface is moving when a skier propels himself into engagement therewith, there is a great likelihood that the relative movement of the surface and the skier will trip or cause the skier to lose balance and to fall.

Having described only one typical preferred form and application of my invention, I do not wish to be limited to the specific details herein set forth, but wish to reserve to myself any modifications and/or variations that may appear to those skilled in the art and which fall within the scope of the following claims:

I claim:

1. A simulated ski slope slide structure comprising:

an elongate forwardly and downwardly inclined deck with top and bottom surfaces, front and rear ends and opposed sides;

an elongate endless carrier belt with inner and outer surfaces and including a longitudinally extending upper portion above the deck with its inner surface in sliding supported engagement therewith, a longitudinally extending lower portion freely below the deck and front and rear recurvant end portions extending between related ends of said upper and lower portions and about the front and rear ends of the deck;

primary roller means adjacent the front and rear ends of the deck and engaging the carrier belt;

means rotatably driving the roller means whereby the carrier belt is moved about the deck with said upper portion thereof moving rearwardly and upwardly across the deck;

a bed of flaked ice on and carried by the carrier belt at the outer surface thereof and presenting a substantially upwardly disposed skiing surface at the upper portion of the belt;

an elongate endless retaining belt with inside and outside surfaces and including a top portion extending longitudinally below the lower portion of the carrier belt with its outer surface in supporting and driving engagement with the bed of ice on the lower portion of the carrier belt, whereby said bed of ice is held engaged on the carrier belt, a bottom portion extending longitudinally below said top portion and front and rear turned end portions between and joining the top and bottom portions; and second roller means supporting the carrier belt for free movement of that belt with the carrier belt.

2. The slide structure set forth in claim 1 wherein said carrier belt is established of carpet material having a flat back defining its inner surface and a fibrous pile defining its outer surface, with said bed of ice at the outer surface of the carrier belt being inter-engaged with the pile, whereby the bed and carrier belt are mechanically locked together.

3. The slide structure set forth in claim 2 wherein the outside surface of the retaining belt is textured and impresses a corresponding texture in the surface of the bed of ice when it is engaged with said bed of ice.

4. The slide structure set forth in claim 1 wherein the outside surface of the retaining belt is textured and impresses a corresponding texture in the surface of the bed of ice when it is engaged with said bed of ice.

5. The structure set forth in claim 1 wherein said primary roller means includes a forward roller adjacent the front end of the deck and about which the forward portion of the carrier belt is engaged; said secondary roller means includes an upper guide roller in spaced relationship above said forward roller and about which the front portion of the retaining belt is engaged to direct the front portion of the retaining belt upwardly and rearwardly about the forward half of said forward roller, a front idler roller spaced forward from said forward roller and about which the front portion of the retaining belt extending from said guide roller is engaged and from which the bottom portion of the retaining belt extends.

6. The slide structure set forth in claim 5 wherein said carrier belt is established of carbet material having a flat back defining its inner surface and a fibrous pile definings it outer surface; ice flakes of said bed of ice at the outer surface of the carrier belt are inter-engaged with the pile whereby the bed and carrier belt are mechanically locked together.

7. The slide structure set forth in claim 6 wherein the outside surface of the retaining belt is textured and impresses a corresponding texture in the surface of the bed of ice when it is engaged with said bed of ice.

8. The structure set forth in claim 1 wherein said primary roller means includes a rear roller adjacent the rear end of the deck and about which the rear end of the carrier belt is engaged; said secondary roller means includes an upper roller spaced rearward from the rear roller and about which the rear portion of the retaining belt is engaged and which directs the carrier belt forwardly and downwardly toward the lower portion of the rear roller, whereby the rear portion of the carrier belt and the portion of the retaining belt extending between the rear roller and the rear end portion of the carrier belt define a transversely extending upwardly opening trough across the rear end of the carrier belt into which loose ice flakes, advanced over the rear of the carrier belt, drop to engage the retaining belt for transport forwardly into re-engagement with the bed of ice.

9. The slide structure set forth in claim 8 wherein said carrier belt is established of carpet material having a flat back defining its inner surface and a fibrous pile defining its outer surface, ice flakes of said bed of ice at the outer surface of the carrier belt are inter-engaged with the pile, whereby the bed and carrier belt are mechanically locked together.

10. The slide structure set forth in claim 9, wherein the outside surface of the retaining belt is textured and impresses a corresponding texture in the surface of the bed of ice when it is engaged with said bed of ice.

* * * * *